US006377144B1

(12) United States Patent
Castonguay et al.

(10) Patent No.: US 6,377,144 B1
(45) **Date of Patent: *Apr. 23, 2002**

(54) MOLDED CASE CIRCUIT BREAKER BASE AND MID-COVER ASSEMBLY

(75) Inventors: Roger Castonguay, Terryville; Dave S. Christensen, Burlington; Dean Robarge, Southington; Randy Greenberg, Granby, all of CT (US)

(73) Assignee: General Electric Company, Schenectady, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/433,029

(22) Filed: Nov. 3, 1999

(51) Int. Cl.[7] ..... H01H 9/02; H01H 13/04
(52) U.S. Cl. ..... 335/202; 335/8
(58) Field of Search ..... 335/6, 16, 8, 35, 335/202, 201; 200/293–305; 218/154–157

(56) References Cited

U.S. PATENT DOCUMENTS

| | | | |
|---|---|---|---|
| 2,340,682 | A | 2/1944 | Powell |
| 2,719,203 | A | 9/1955 | Gelzheiser et al. |
| 2,937,254 | A | 5/1960 | Ericson |
| 3,158,717 | A | 11/1964 | Jencks et al. |
| 3,162,739 | A | 12/1964 | Klein et al. |
| 3,197,582 | A | 7/1965 | Norden |
| 3,307,002 | A | 2/1967 | Cooper |
| 3,517,356 | A | 6/1970 | Hanafusa |
| 3,631,369 | A | 12/1971 | Menocal |
| 3,803,455 | A | 4/1974 | Willard |
| 3,883,781 | A | 5/1975 | Cotton |
| 4,129,762 | A | 12/1978 | Bruchet |
| 4,144,513 | A | 3/1979 | Shafer et al. |
| 4,158,119 | A | 6/1979 | Krakik |
| 4,165,453 | A | 8/1979 | Hennemann |
| 4,166,988 | A | 9/1979 | Ciarcia et al. |
| 4,220,934 | A | 9/1980 | Wafer et al. |
| 4,255,732 | A | 3/1981 | Wafer et al. |
| 4,259,651 | A | 3/1981 | Yamat |
| 4,263,492 | A | 4/1981 | Maier et al. |
| 4,276,527 | A | 6/1981 | Gerbert-Gaillard et al. |
| 4,297,663 | A | 10/1981 | Seymour et al. |
| 4,301,342 | A | 11/1981 | Castonguay et al. |
| 4,360,852 | A | 11/1982 | Gillmore |
| 4,368,444 | A | 1/1983 | Preuss et al. |
| 4,375,021 | A | 2/1983 | Pardini et al. |
| 4,375,022 | A | 2/1983 | Daussin et al. |
| 4,376,270 | A | 3/1983 | Staffen |
| 4,383,146 | A | 5/1983 | Bur |
| 4,392,036 | A | 7/1983 | Troebel et al. |
| 4,393,283 | A | 7/1983 | Masuda |
| 4,401,872 | A | 8/1983 | Boichot-Castagne et al. |
| 4,409,573 | A | 10/1983 | DiMarco et al. |
| 4,435,690 | A | 3/1984 | Link et al. |
| 4,467,297 | A | 8/1984 | Boichot-Castagne et al. |

(List continued on next page.)

FOREIGN PATENT DOCUMENTS

| | | |
|---|---|---|
| DE | 12 27 978 | 11/1966 |
| DE | 30 47 360 | 6/1982 |
| DE | 38 02 184 | 8/1989 |

(List continued on next page.)

*Primary Examiner*—Lincoln Donovan
*Assistant Examiner*—Tuyen T. Nguyen
(74) *Attorney, Agent, or Firm*—Cantor Colburn LLP

(57) ABSTRACT

A molded case circuit breaker housing employs a trifurcated design that imparts structural stability and manufacturing efficiency. The design provides a separate top cover, mid-cover and base wherein the mid-cover wall height to base wall height ratio is such that the stresses imparted upon the base sidewalls when pressures are exerted, for example, by gaseous discharges are withstood.

20 Claims, 6 Drawing Sheets

U.S. PATENT DOCUMENTS 4,468,645 A 8/1984 Gerbert-Gaillard et al.
4,470,027 A 9/1984 Link et al.
4,479,143 A 10/1984 Watanabe et al.
4,488,133 A 12/1984 McClellan et al.
4,492,941 A 1/1985 Nagel
4,541,032 A 9/1985 Schwab
4,546,224 A 10/1985 Mostosi
4,550,360 A 10/1985 Dougherty
4,562,419 A 12/1985 Preuss et al.
4,589,052 A 5/1986 Doughtery
4,595,812 A 6/1986 Tamaru et al.
4,611,187 A 9/1986 Banfi
4,612,430 A 9/1986 Sloan et al.
4,616,198 A 10/1986 Pardini
4,622,444 A 11/1986 Kandatsu et al.
4,631,625 A 12/1986 Alexander et al.
4,642,431 A 2/1987 Tedesco et al.
4,644,438 A 2/1987 Puccinelli et al.
4,649,247 A 3/1987 Preuss et al.
4,658,322 A 4/1987 Rivera
4,672,501 A 6/1987 Bilac et al.
4,675,481 A 6/1987 Markowski et al.
4,682,264 A 7/1987 Demeyer
4,689,712 A 8/1987 Demeyer
4,694,373 A 9/1987 Demeyer
4,710,845 A 12/1987 Demeyer
4,717,985 A 1/1988 Demeyer
4,733,211 A 3/1988 Castonguay et al.
4,733,321 A 3/1988 Lindeperg
4,764,650 A 8/1988 Bur et al.
4,768,007 A 8/1988 Mertz et al.
4,780,786 A 10/1988 Weynachter et al.
4,831,221 A 5/1989 Yu et al.
4,870,531 A 9/1989 Danek
4,883,931 A 11/1989 Batteux et al.
4,884,047 A 11/1989 Baginski et al.
4,884,164 A 11/1989 Dziura et al.
4,900,882 A 2/1990 Bernard et al.
4,910,485 A 3/1990 Bolongeat-Mobleu et al.
4,914,541 A 4/1990 Tripodi et al.
4,916,420 A 4/1990 Bartolo et al.
4,916,421 A 4/1990 Pardini et al.
4,926,282 A 5/1990 McGhie
4,935,590 A 6/1990 Malkin et al.
4,937,706 A 6/1990 Schueller et al.
4,939,492 A 7/1990 Raso et al.
4,943,691 A 7/1990 Mertz et al.
4,943,888 A 7/1990 Jacob et al.
4,950,855 A 8/1990 Bolonegeat-Mobleu et al.
4,951,019 A 8/1990 Gula
4,952,897 A 8/1990 Barnel et al.
4,958,135 A 9/1990 Baginski et al.
4,965,543 A 10/1990 Batteux
4,983,788 A 1/1991 Pardini
5,001,313 A 3/1991 Leclerq et al.
5,004,878 A 4/1991 Seymour et al.
5,027,096 A * 6/1991 White et al. ..... 335/202
5,029,301 A 7/1991 Nebon et al.
5,030,804 A 7/1991 Abri
5,057,655 A 10/1991 Kersusan et al.
5,059,931 A * 10/1991 Lesslie ..... 335/132
5,077,627 A 12/1991 Fraisse
5,083,081 A 1/1992 Barrault et al.
5,095,183 A 3/1992 Raphard et al.
5,103,198 A 4/1992 Morel et al.
5,115,371 A 5/1992 Tripodi
5,120,921 A 6/1992 DiMarco et al.
5,132,865 A 7/1992 Mertz et al.
5,138,121 A 8/1992 Streich et al.
5,140,115 A 8/1992 Morris
5,153,802 A 10/1992 Mertz et al.
5,155,315 A 10/1992 Malkin et al.
5,166,483 A 11/1992 Kersusan et al.
5,172,087 A 12/1992 Castonguay et al.
5,178,504 A 1/1993 Falchi
5,184,717 A 2/1993 Chou et al.
5,187,339 A 2/1993 Lissandrin
5,198,956 A 3/1993 Dvorak
5,200,724 A 4/1993 Gula et al.
5,210,385 A 5/1993 Morel et al.
5,239,150 A 8/1993 Bolongeat-Mobleu et al.
5,260,533 A 11/1993 Livesey et al.
5,262,744 A 11/1993 Arnold et al.
5,280,144 A 1/1994 Bolongeat-Mobleu et al.
5,281,776 A 1/1994 Morel et al.
5,296,660 A 3/1994 Morel et al.
5,296,664 A 3/1994 Crookston et al.
5,298,874 A * 3/1994 Morel et al. ..... 335/8
5,300,907 A 4/1994 Nereau et al.
5,310,971 A 5/1994 Vial et al.
5,313,180 A 5/1994 Vial et al.
5,317,471 A 5/1994 Izoard et al.
5,331,500 A 7/1994 Corcoles et al.
5,334,808 A 8/1994 Bur et al.
5,341,191 A 8/1994 Crookston et al.
5,347,096 A 9/1994 Bolongeat-Mobleu et al.
5,347,097 A 9/1994 Bolongeat-Mobleu
5,350,892 A 9/1994 Rozier
5,357,066 A 10/1994 Morel et al.
5,357,068 A 10/1994 Rozier
5,357,394 A 10/1994 Piney
5,361,052 A 11/1994 Ferullo et al.
5,373,130 A 12/1994 Barrault et al.
5,379,013 A 1/1995 Coudert
5,424,701 A 6/1995 Castonguary et al.
5,438,176 A 8/1995 Bonnardel et al.
5,440,088 A 8/1995 Coudert et al.
5,449,871 A 9/1995 Batteux et al.
5,450,048 A 9/1995 Leger et al.
5,451,729 A 9/1995 Onderka et al.
5,457,295 A 10/1995 Tanibe et al.
5,467,069 A 11/1995 Payet-Burin et al.
5,469,121 A 11/1995 Payet-Burin
5,475,558 A 12/1995 Barjonnet et al.
5,477,016 A 12/1995 Baginski et al.
5,479,143 A 12/1995 Payet-Burin
5,483,212 A 1/1996 Lankuttis et al.
5,485,343 A 1/1996 Santos et al.
D367,265 S 2/1996 Yamagata et al.
5,493,083 A 2/1996 Olivier
5,504,284 A 4/1996 Lazareth
5,504,290 A 4/1996 Baginski et al.
5,510,761 A 4/1996 Boder et al.
5,512,720 A 4/1996 Coudert et al.
5,515,018 A 5/1996 DiMarco et al.
5,519,561 A 5/1996 Mrenna et al.
5,534,674 A 7/1996 Steffens
5,534,832 A 7/1996 Duchemin et al.
5,534,835 A 7/1996 McColloch et al.
5,534,840 A 7/1996 Cuingnet
5,539,168 A 7/1996 Linzenich
5,543,595 A 8/1996 Mader et al.
5,552,755 A 9/1996 Fello et al.
5,581,219 A 12/1996 Nozawa et al.
5,604,656 A 2/1997 Derrick et al.
5,608,367 A 3/1997 Zeller et al.
5,784,233 A 7/1998 Bastard et al.
6,002,313 A * 12/1999 Mrenna et al. ..... 335/202

FOREIGN PATENT DOCUMENTS

DE 38 43 277 6/1990

| | | |
|---|---|---|
| DE | 44 19 240 | 1/1995 |
| EP | 0 061 092 | 9/1982 |
| EP | 0 064 906 | 11/1982 |
| EP | 0 066 486 | 12/1982 |
| EP | 0 076 719 | 4/1983 |
| EP | 0 177 094 | 8/1984 |
| EP | 0 140 761 | 5/1985 |
| EP | 0 174 904 | 3/1986 |
| EP | 0 196 241 | 10/1986 |
| EP | 0 224 396 | 6/1987 |
| EP | 0 235 479 | 9/1987 |
| EP | 0 239 460 | 9/1987 |
| EP | 0 258 090 | 3/1988 |
| EP | 0 264 313 | 4/1988 |
| EP | 0 264 314 | 4/1988 |
| EP | 0 283 189 | 9/1988 |
| EP | 0 283 358 | 9/1988 |
| EP | 0 291 374 | 11/1988 |
| EP | 0 295 155 | 12/1988 |
| EP | 0 295 158 | 12/1988 |
| EP | 0 309 923 | 4/1989 |
| EP | 0 313 106 | 4/1989 |
| EP | 0 314 540 | 5/1989 |
| EP | 0 331 586 | 9/1989 |
| EP | 0 337 900 | 10/1989 |
| EP | 0 342 133 | 11/1989 |
| EP | 0 367 690 | 5/1990 |
| EP | 0 371 887 | 6/1990 |
| EP | 0 375 568 | 6/1990 |
| EP | 0 394 144 | 10/1990 |
| EP | 0 394 922 | 10/1990 |
| EP | 0 399 282 | 11/1990 |
| EP | 0 407 310 | 1/1991 |
| EP | 0 452 230 | 10/1991 |
| EP | 0 555158 | 8/1993 |
| EP | 0 560 697 | 9/1993 |
| EP | 0 567 416 | 10/1993 |
| EP | 0 619 591 | 1/1994 |
| EP | 0 595 730 | 5/1994 |
| EP | 0 665 569 | 8/1995 |
| EP | 0 700 140 | 3/1996 |
| EP | 0 889 498 | 1/1999 |
| FR | 2 410 353 | 6/1979 |
| FR | 2 512 582 | 3/1983 |
| FR | 2 553 943 | 4/1985 |
| FR | 2 592 998 | 7/1987 |
| FR | 2 682 531 | 4/1993 |
| FR | 2 697 670 | 5/1994 |
| FR | 2 699 324 | 6/1994 |
| FR | 2 714 771 | 7/1995 |
| GB | 2 233 155 | 1/1991 |
| WO | 92/00598 | 1/1992 |
| WO | 92/05649 | 4/1992 |
| WO | 94/00901 | 1/1994 |

* cited by examiner

MOLDED CASE CIRCUIT BREAKER BASE AND MID-COVER ASSEMBLY

BACKGROUND OF THE INVENTION

The present invention relates to molded case circuit breaker enclosures. More particularly the present invention relates to a base and mid-cover configuration for circuit breaker enclosures.

Circuit breaker enclosures are typically manufactured having a deep base for enclosing the components of a circuit breaker (i.e., a circuit breaker cassettes) and a cover having an opening for an operating handle (a bifurcated case). In existing circuit breaker enclosures, the base is constructed with sidewalls that extend to a height approaching or exceeding the height of the circuit breaker cassettes when upon the floor of the base. Other designs employ a divided cover, where in a mid-cover connects to the base and the top cover connects to the mid-cover and has an opening for the operating handle (a trifurcated case). The mid-cover may also comprise accessory recesses and/or trip actuator recesses positioned in mechanical cooperation with the operating handle of the circuit breaker. As with a bifurcated case, typical sidewalls of trifurcated case bases approach or exceed the height of the circuit breaker cassettes.

Typically, in trifurcated circuit breaker enclosures the height of the mid-cover wall is small in relation to the height of the base sidewalls. This is likely due to the limited purpose of existing mid-covers, i.e., to house accessories and trip actuators, which generally have a small height in comparison to the circuit breaker cassettes. The ratio of the mid-cover height $H_{mc}$ to the base height $H_b$ ($H_{mc}/H_b$) in prior circuit breakers molded case is less than about 0.45.

However, with relatively small $H_{mc}/H_b$ ratios, manufacturing is difficult as the base must be relatively high for a very thin structure. This creates problems in the molding of the thermoplastic materials and increases the effort required to provide a finished product having thermoplastic resin and filler evenly distributed.

Further, a structural problem arises due to the high, thin sidewalls of the base. As gases are exerted when the circuit breaker cassettes trip, the stresses created cause the circuit breaker enclosure to deform and possibly crack at the base sidewalls.

Therefore, a need exist for a molded circuit breaker case that is easier to mold and that provides suitable structural integrity.

BRIEF SUMMARY OF THE INVENTION

A molded circuit breaker enclosure is provided having a base, a mid-cover, and a top-cover. The base includes generally parallel sidewalls, a bottom wall, a lined end dividing portion. The mid-cover comprises generally parallel sidewalls, and a load end dividing structure. Circuit breaker components, such as one or more circuit breaker cassettes, are positioned within the base of the circuit breaker. A mid-cover is removably affixed on top of the base sidewalls, and are secured there to, for example, on a pressed fit frictional engagement, interference engagement, fastener adhesive or any combination thereof. The top-cover has a slot to allow a handle to extend therethrough.

The circuit breaker enclosures must withstand mechanical stresses caused by the high gas pressure generated when a short circuit occurs. Accordingly, it is beneficial to transfer the stresses from the sidewalls of the base to the cover or the combined mid-cover and top-cover assembly. This may be accomplished by providing a step on the upper edge of the sidewalls of the base and a corresponding step on the bottom edge of the mid-cover sidewalls in a trifurcated case or cover sidewalls in a bifurcated case.

In an exemplary embodiment of the present invention, the ratio of the midcover sidewall height to the base sidewall height is at least 0.45. In a most preferred embodiment, the ratio is between 0.61 and 1.63.

DESCRIPTION OF THE PREFERRED EMBODIMENT

Figure 1:
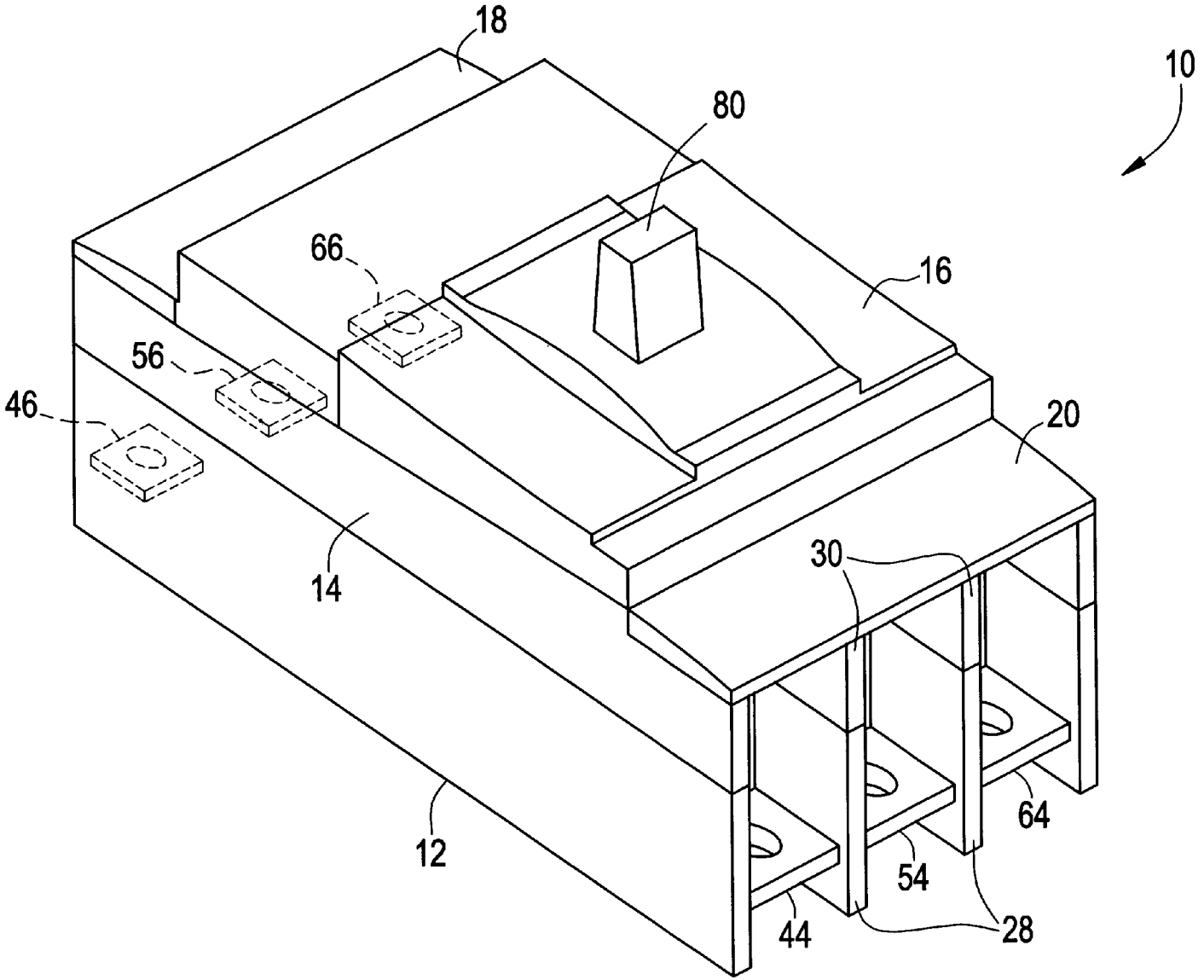
FIG. 1 is a top perspective view of an assembled molded case circuit breaker.

A molded circuit breaker case 10 is generally shown in FIG. 1. The molded circuit breaker case 10 generally includes an electronic trip unit (not shown) for overcurrent protection and also may include at least one auxiliary electrical accessory, such as auxiliary switches, shunt trip elements and under-voltage sensing units. Molded circuit breaker case 10 generally includes an insulated base 12, a mid-cover 14 and a top- cover 16. Disposed within the molded case are plurality of breaker cassettes 40, 50 and 60 (not shown) including line terminal straps 44, 54 and 64 and load terminal straps 46, 56 and 66 (shown in phantom view). Load terminal straps 46, 56 and 66 are physically and electrically separated from each other by base load terminal dividing walls 28 and two mid-cover line terminal dividing walls 30. When mid-cover 14 is attached to case 12, the downwardly extending mid-cover load terminal dividing walls 30 align with corresponding upstanding base line terminal dividing walls 28 integrally formed within the case to electrically isolate the bad connections within a multi-phase electrical circuit. Likewise, line terminal straps 44, 54 and 64 are physically and electrically separated from each other by two base load terminal divider walls (not shown) and two mid-cover line divider walls (not shown).

Mid-cover 14 is disposed generally between base 12 and top cover 16. Mid-cover 14 is secured to base 12 by a combination of fasteners and one or more frictional engagements such as a press fit engagement. Top-cover 16 is secured to mid-cover 14 by a plurality of fasteners. Further, circuit breaker case 10 may include load strap cover 18 and line strap cover 20 removably or permanently affixed to mid-cover 14 to prevent top access to the terminal straps 46, 56, 66 and 44, 54, 64 respectively. Load strap cover 18 and line strap cover 20 may be secured to mid-cover 14 in a press-fit manner. It is well known to one skilled in the art that alternative methods for securing the mid-cover to the base may be employed, for example, adhesives, interference engagements, fasteners, frictional engagements, or any combination thereof. It is also well know to one skilled in the art that top-cover 16, load strap cover 18 and line strap cover 20 may be secured to mid-cover 14 by a variety of methods, for example, adhesives, interference engagements, fasteners, frictional engagements, or any combination thereof.

Top-cover 16 includes an operating handle slot 82 (see FIG. 2) to allow circuit breaker operating handle 80 to pass therethrough. Operating handle 80 controls the circuit breaker cassettes via a connection with an internal mechanism (not shown).

Figure 2:
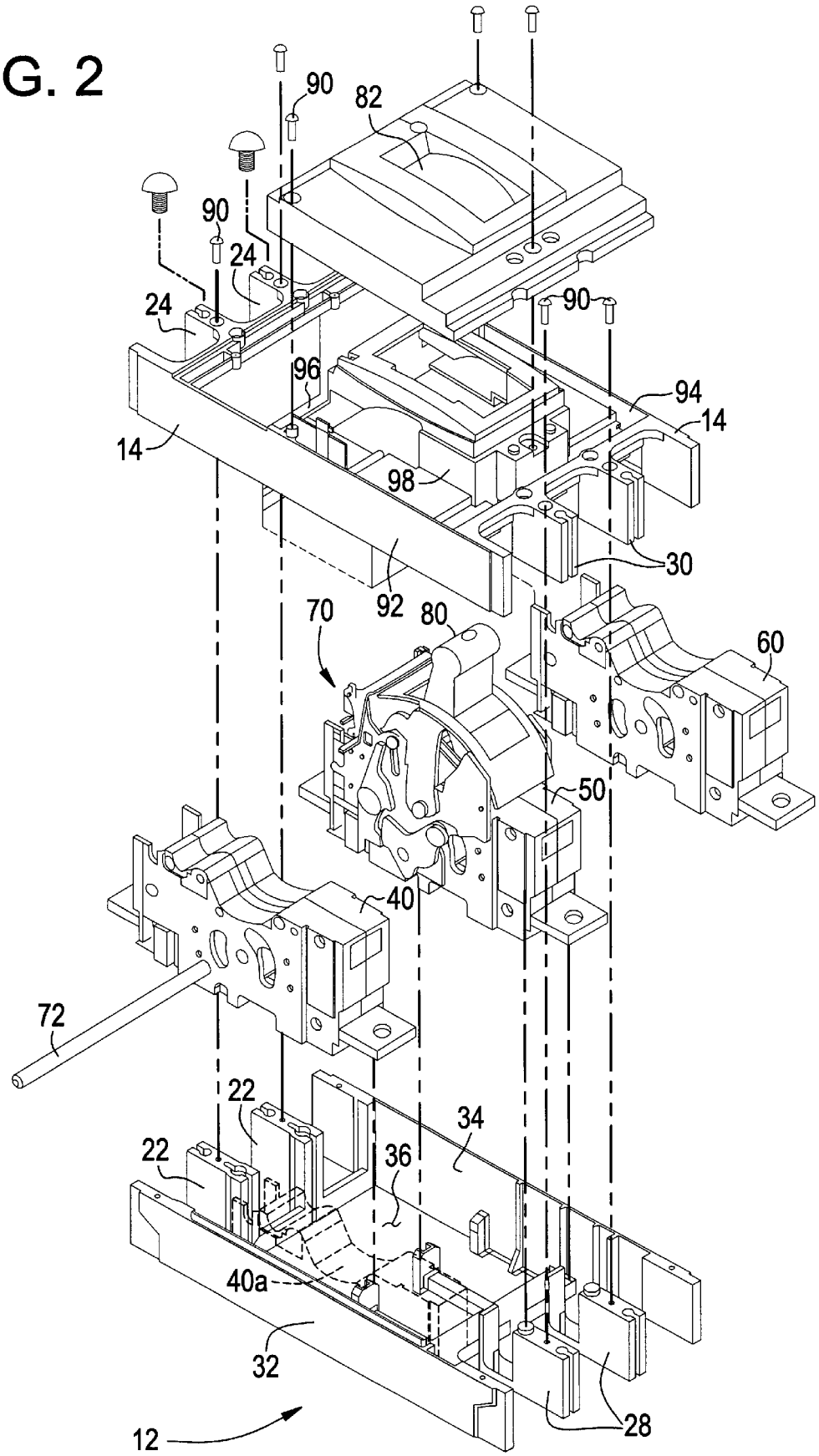
FIG. 2 is an exploded side perspective view of a molded case circuit breaker showing the enclosure structure and general internal components.

Referring to FIG. 2, an exploded side perspective view of the circuit breaker molded case of the present invention is depicted. Base 12 comprises opposed upstanding sidewalls 32 and 34, base floor 36, upstanding baseline terminal divider walls 28, and upstanding load terminal divider walls 22. Sidewalls 32 and 34 comprise a top lipped edge, the outside of which received inside of the bottom edge of the mid-cover sidewalls in a pressed fit manner (described in further detail herein with reference to FIG. 9).

Circuit breaker cassettes 40, 50 and 60 are disposed in an upstanding fashion within base 12 upon base floor 36, such that cassette 40 is adjacent to sidewall 32, cassette 60 is adjacent to sidewall 34, and cassette 50 is disposed between cassette 40 and 60. The handle 80 is attached to an internal mechanism 70, which is coupled with the center cassette 50. Center cassette 50 is coupled withcassettes 40 and 60 by the drive pin 72. Cassettes 40, 50 and 60 engage and disengage simultaneously by drive pin 72. The height of the circuit breaker cassettes is greater than the height of the base sidewalls, as apparent by a view of an inserted cassette 40, shown in phantom at 40*a*.

Cassettes 40, 50 and 60 along with mechanism 70 are assembled into the base 12 and retain therein by mid-cover 14. Mid-cover 14 is connected to base 12 by any convenient means, such as screws 90, snap fit or adhesive bonding. Specifically, in the embodiment depicted in FIG. 2, mid-cover 14 is secured to base 12 generally by press fit engagements about the middle portion of opposing sidewalls 92 and 94, and via fasteners or screws 90 through mid-cover line terminal divider walls 30 and mid-cover load end divider walls 24. Thus, side-walls 92 and 94 of mid-cover 14, in conjunction with sidewalls 32 and 34 of base 12, form protective walls for the outer side of circuit breaker cassettes 40 and 60. Further, base divider walls 18 and 22 and mid-cover divider walls 30 and 24 structurally depend from support portions extending generally from sidewall 32 and 34 of the base and sidewall 92 and 94 of the mid-cover, respectively, generally perpendicular to the divider walls and sidewalls.

Mid-cover 14 further includes a central support portion 96 formed between sidewalls 92 and 94 to cover the top surfaces of cassettes 40 and 60 and to provide structural integrity to the mid-cover. Central support portion 96 generally includes opposing upstanding walls 98 between which internal mechanism 70 is disposed and operating handle 80 passes through. Optional accessories may be disposed within mid-cover 14 between support portion walls 98 and either of mid-cover sidewalls 92 or 94.

The top portion end of circuit breaker cassettes 40, 50 and 60 are covered by mid-cover 14. The operating handle 80 is accessible via opening 82 upon top-cover 16. Top cover 16 is secured to mid-cover 14 by fasteners 92 which engage corresponding receptacles upon mid-cover 14. It is known that top-cover 16 may further include openings or viewing windows to access and/or see visual displays upon various accessories.

Figure 3:
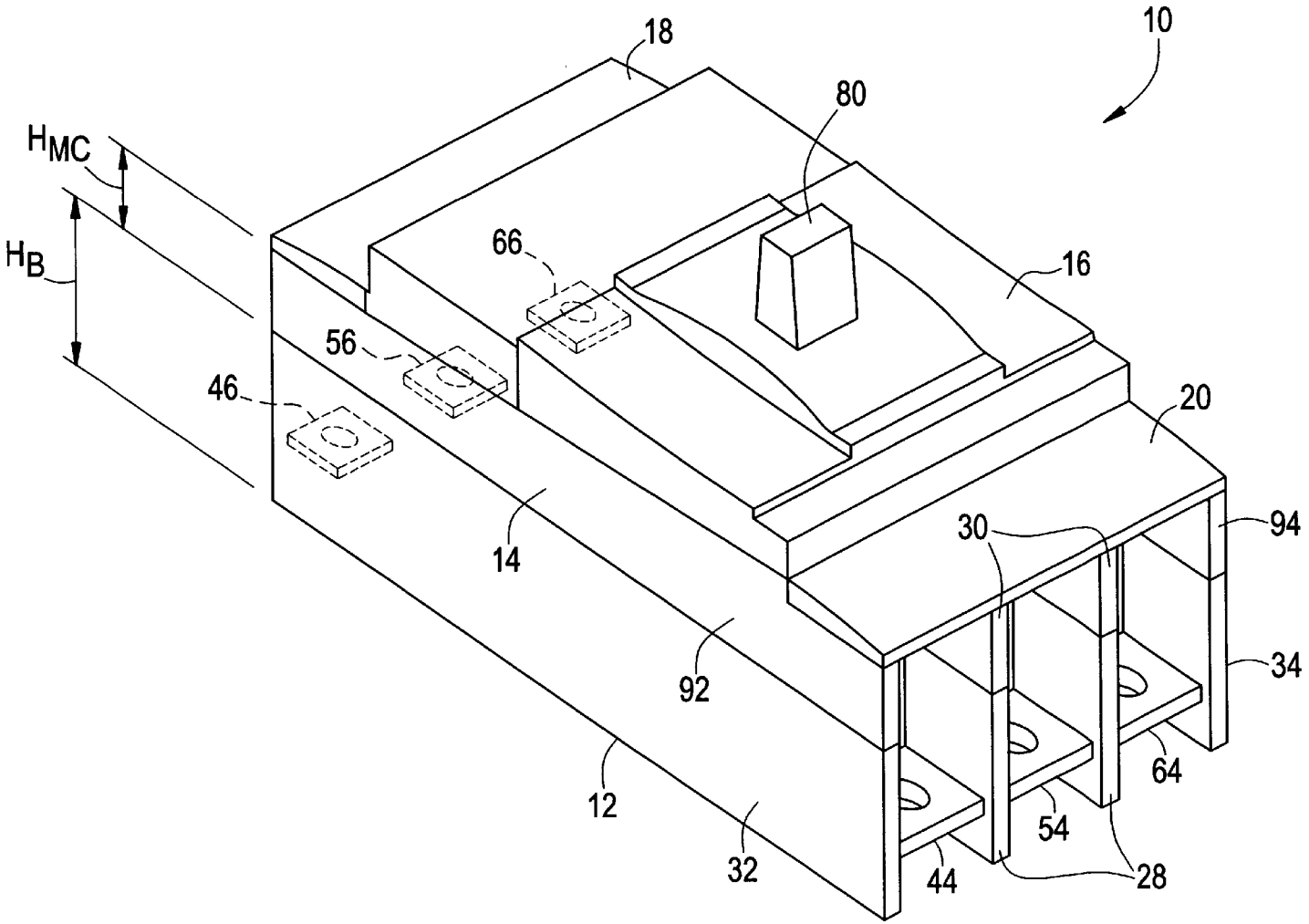
FIG. 3 is a top perspective view of a molded case circuit breaker with mid-cover and base heights indicated.

Referring to FIG. 3, an assembled molded case circuit breaker of the present invention is depicted, wherein the heights of the mid-cover sidewalls and base sidewall are indicated as $H_b$ and $H_{mc}$. The height of base sidewalls 32 and 34, $H_b$, is depicted as 5.4 cm (2.125 inches). The height of the sidewalls 92 and 94 of mid-cover 14, $H_{mc,}$ is depicted as 3.3 cm (1.3 inches). Thus, the ratio of the height of the mid-cover to the height of the base, $H_{mc}/H_b$, is 0.6117 in the depicted embodiment.

Generally, prior art molded case circuit breaker the same overall size have a smaller ratio of the height of the mid-cover to the height of the base. That is, the height of the sidewall of mid-cover is typically 2.7 cm (1.063 inches) or less and the height of the base sidewall is typically 6 cm (2.362 inches) or more, providing a ratio of approximately 0.44–0.46 or less.

Figure 4:
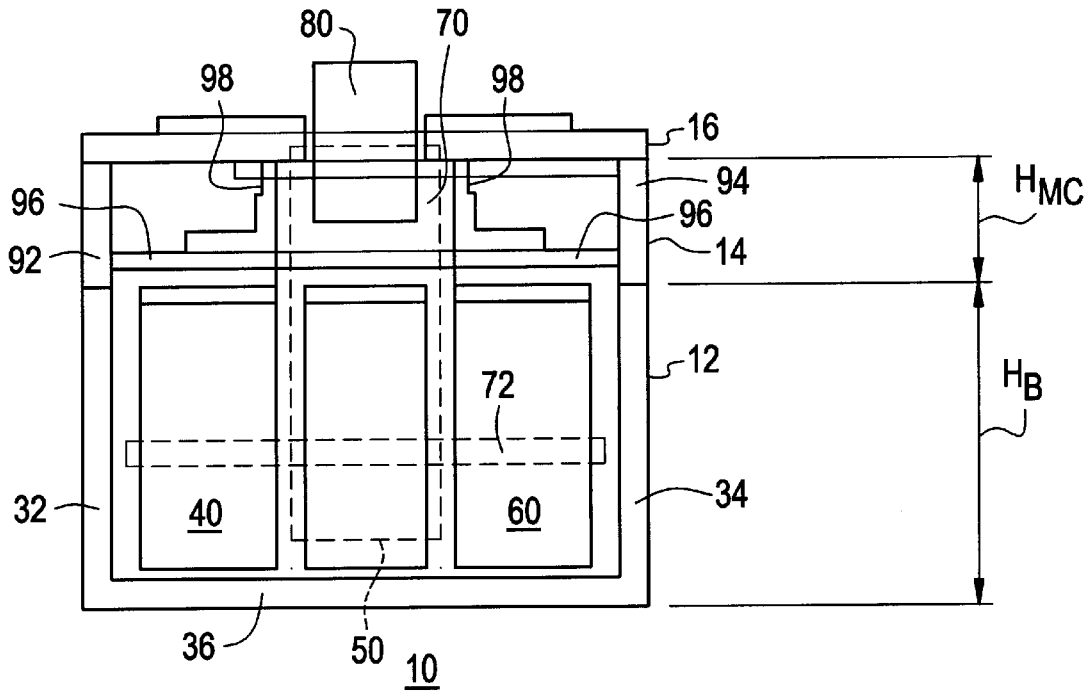
FIG. 4 PRIOR ART
FIGS. 4 and 5 are cross-sectional views of a prior art circuit breaker case and a case of the present invention; respectively.

Referring now to FIG. 4 a cross-sectional view of a prior art circuit breaker case 10 is indicated. Upstanding circuit breaker cassettes 40, 50 and 60 are disposed within circuit breaker case 10. Internal mechanism 70 (shown in phantom) is pivotally attached to operating handle 80 and envelopes the sidewalls of center cassette 50 and common movement throughout cassettes 40, 50 and 60 is effectuated via drive pin 72 (shown in phantom). Also shown are heights $H_b$ and $H_{mc}$. In prior art circuit breaker cases, upstanding cassettes 40, 50 and 60 extend to a height approaching $H_b$. Thus, the mid-cover sidewalls generally protect any accessories provided.

Figure 5:
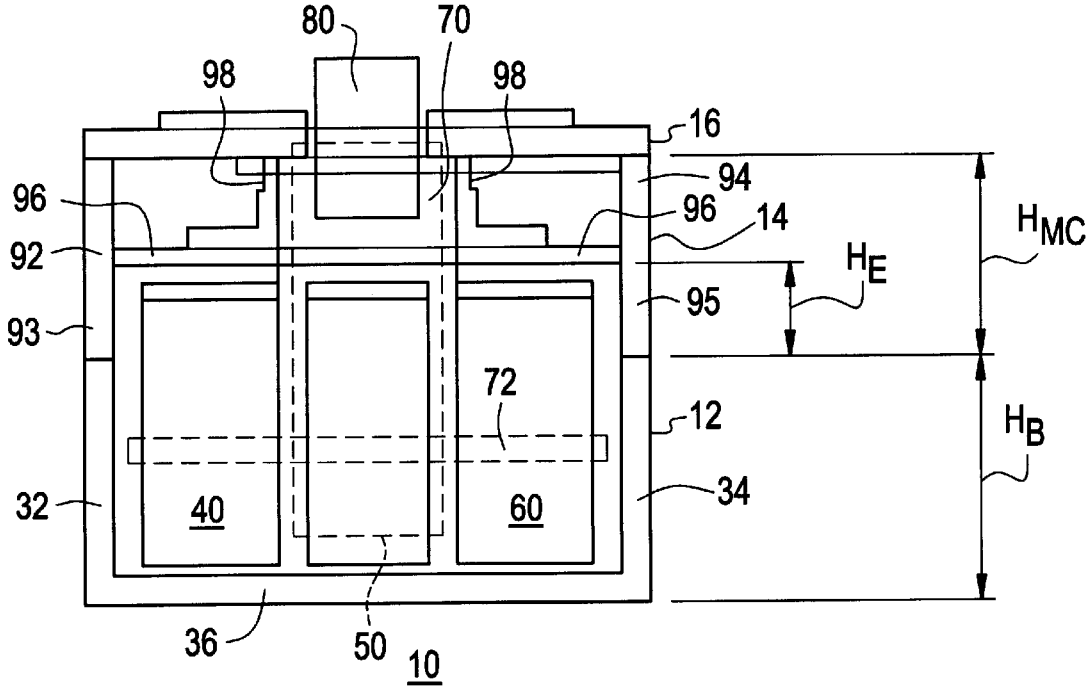

Referring now to FIG. 5 a cross-sectional view of a circuit breaker case 10 of the present invention is indicated. Upstanding circuit breaker cassettes 40, 50 and 60 are disposed within circuit breaker case 10 generally upon base floor 36, and internal mechanism 70 (depicted in phantom) is pivotally attached to operating handle 80 and envelopes the sidewalls of center cassette 50 whereby common movement throughout cassettes 40, 50 and 60 is effectuated via drive pin 72. The heights of base sidewalls 32 and 34 and mid-cover sidewalls 92 and 94, $H_b$ and $H_{mc}$ respectively, are indicated. In the configuration of the present invention, $H_b$ is less than that of prior art circuit breakers and $H_{mc}$ is greater than that of prior art circuit breakers. In the circuit breaker case of the present invention, upstanding cassettes 40, 50 and 60 extend to a height beyond $H_b$. Base sidewalls 32 and 34 enclose the lower portion of circuit breaker cassettes 40, 50 and 60. Mid-cover sidewalls 92 and 94 enclose the upper portion of circuit breaker cassettes 40, 50 and 60 via extended portions 93 and 95 having heights $H_e$. Additionally, mid-cover sidewalls 92 and 94 protect any accessories provided upon the mid-cover support portion 96.

Figure 6:
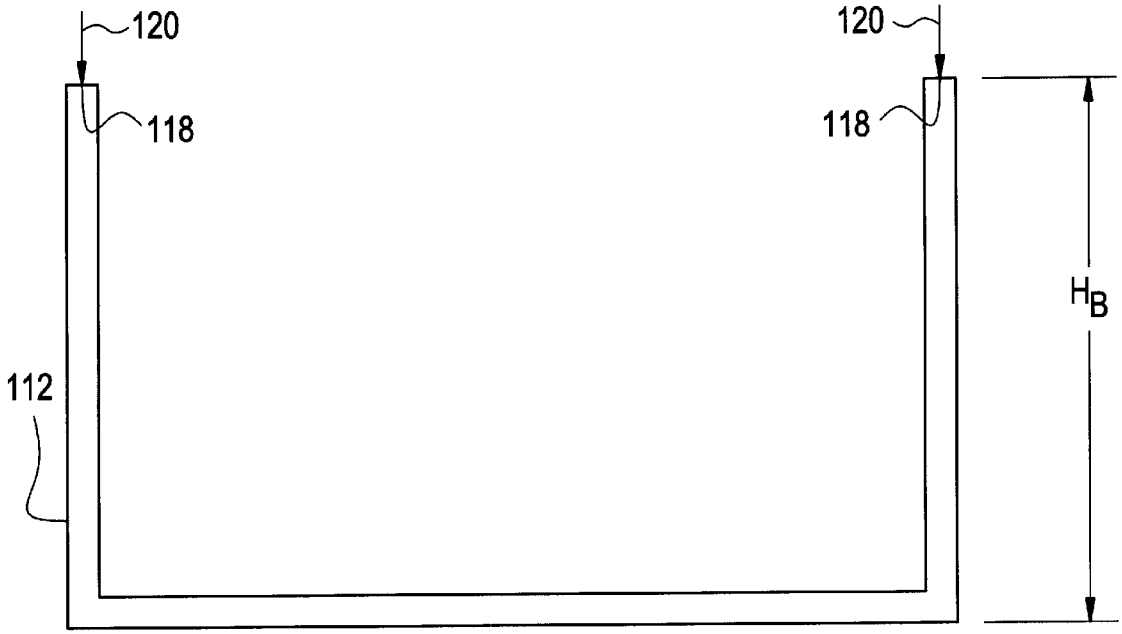
FIG. 6 PRIOR ART
FIGS. 6 and 7 are cross-sectional views of a prior art circuit breaker enclosure base mold and a base mold of the present invention, respectively.

A preferred embodiment of the circuit breaker case 10 of the present invention is fabricated by injection molding of a thermoplastic material. Thermoplastics include a polymeric resin and filler. For molded case circuit breakers, the preferred filler is glass particles, as they impart a high degree of hardness while maintaining the resiliency of the case, thereby minimizing breakage. However, for optimal injection molding manufacture, a consistent mixture of resin and filler is desired. The present invention facilitates such consistency by lessening the distance that the resin/filler distance must travel. Referring to FIG. 6 a cross-sectional view of a circuit breaker base mold of the prior art is indicated at 112. Thermoplastic resin/filler mixture is injected through mold apertures 118 in the direction indicated by arrows 120.

Figure 7:
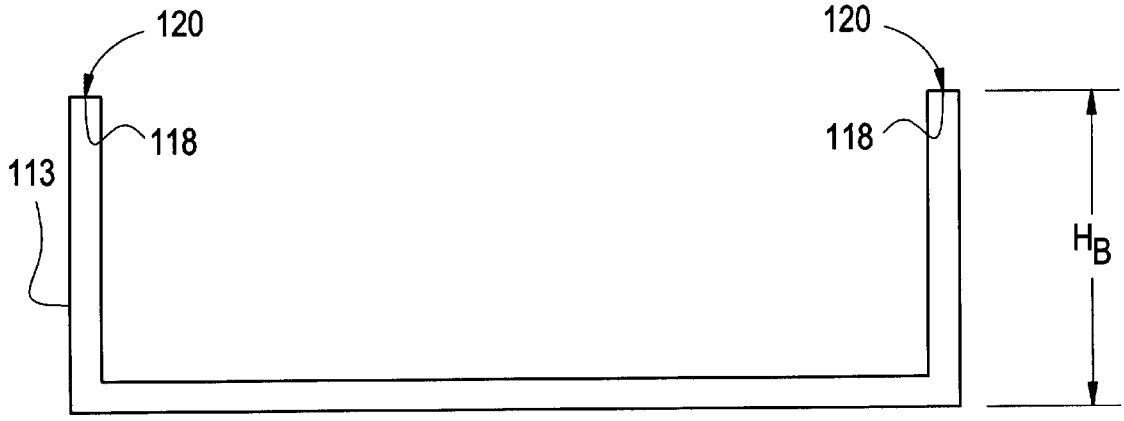

Referring to FIG. 7 a cross-sectional view of a circuit breaker base mold of the present invention is indicated at 113. Thermoplastic resin/filler mixture is injected generally by the same process as with the prior art mold 112, through mold apertures 118 in the direction indicated by arrows 120. However, $H_b$ of the prior art base mold 112 is greater than $H_b$ in base mold 113 of the present invention. Therefore, during the injection molding process, the molten thermoplastic resin/filler mixture that is injected is required to travel a lesser distance in base mold 113 as compared to base mold 112 of the prior art. The tendency of the thermoplastic mixture to separate is due to the lower viscosity of resin compared to the higher viscosity of resin/filler mixture. Consequently, by decreasing the height of the base sidewalls as provided in the present invention, a more consistent filler/resin mixture may be attained while using less injection force, thereby increasing manufacturing efficiency and improving filler mixture throughout the mold.

Figure 8:
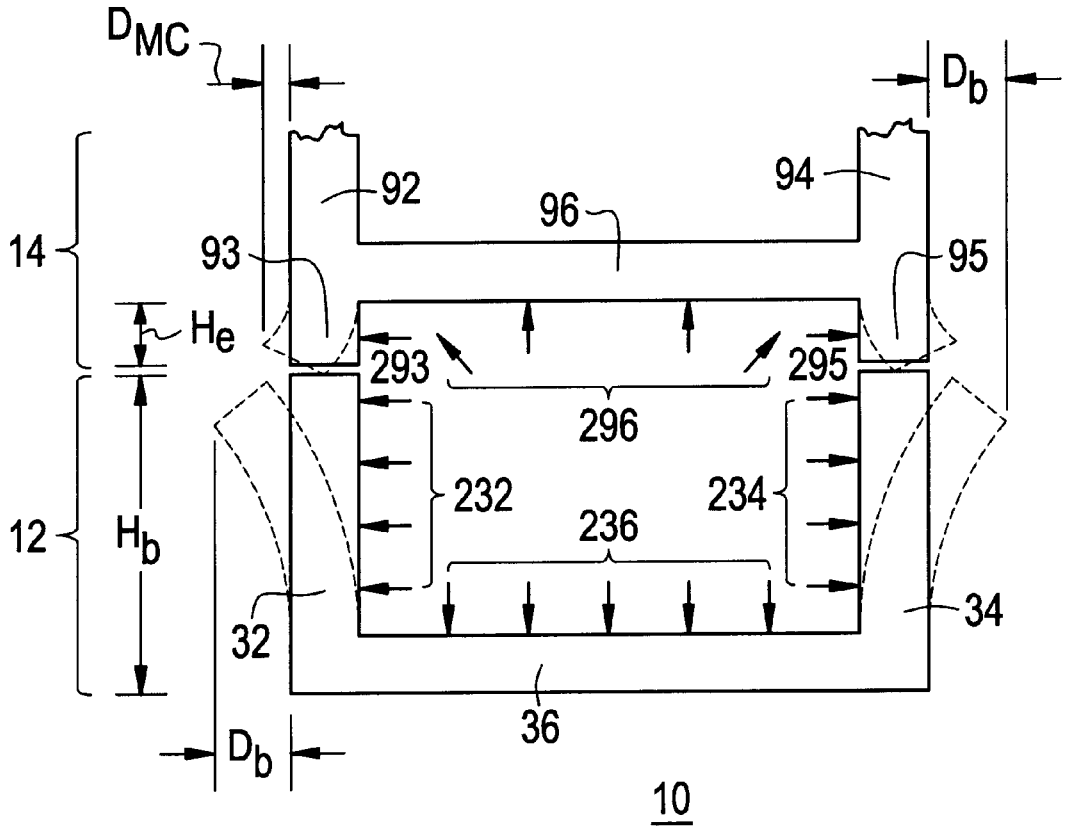
FIG. 8 is a cross-sectional view of a molded circuit breaker enclosure depicting internal forces imported upon the enclosure.

Referring now to FIG. 8, a circuit breaker case 10 of the present invention is shown in cross section without the components therein whereby a stress analysis is shown. Circuit breaker case 10 includes a base 12 having a floor 36 and opposing sidewalls 32 and 34 (whereby $H_b$ indicates the height of base sidewalls 32 and 34), and a mid-cover 14 including a support 96 and opposing sidewalls 92 and 94. Sidewalls 92 and 94 further comprise opposing extended walls 93 and 95, respectively, that extend below mid-cover support structure 96. Base 12 including floor 36 and sidewalls 32 and 34, and mid-cover 14 including support 96 and sidewalls 92 and 94 are acted upon by mechanical forces indicated by arrows 232, 234, 236, 293, 295 and 296. The mechanical forces depicted are exerted by the discharge of gasses from the circuit breaker cassettes 40, 50 and 60 (not shown). The length of extended portions 93 and 95 is indicated by $H_e$. Forces 296 and 236, acting upon the mid-cover support structure 96 and the base floor 36 respectively, are generally constrained by screws 90 (see FIG. 2) disposed between mid-cover 14 and base 12. Forces 293 and 295 act upon the extended portions 93 and 95 respectively, and forces 232 and 234 act upon base sidewalls 32 and 34 respectively. Forces 232 and 234 urge base sidewalls 32 and 34 respectively outward, shown in phantom, to a distance $D_b$. As the distance $D_o$ increases, the tendency of base sidewalls 32 and 34 to crack or break generally about base sidewall-floor juncture points 33 and/or 35 increases. As $H_b$ is decreased to a shorter height, as provided for in the present invention, the maximum $D_b$ also decreases thereby minimizing tendencies for the base sidewalls 32 and 34 to crack or break at points 33 and/or 35. Forces 293 and 295 urge extended portions 93 and 95 respectively outward, shown in phantom, to a distance $D_{mc}$. There is little tendency for $D_{mc}$ to increase far enough as to crack or break extended portions 93 and 95, as $H_e$ is relatively small compared to the restraint from support structure 96.

Figure 9:
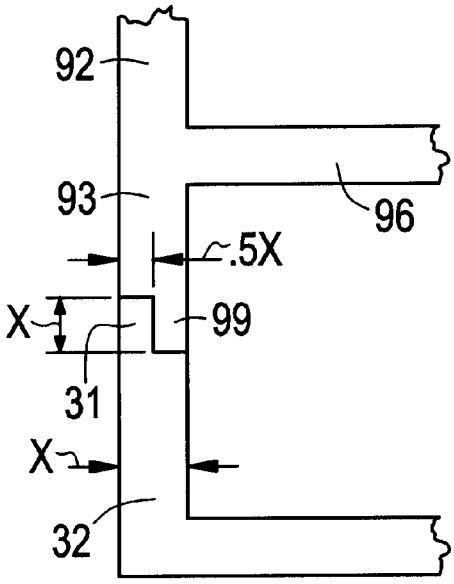
FIG. 9 is an enlarged view of a lap joint that may be employed within preferred embodiments of the present invention.

Additional support may be afforded at the junction of sidewalls 32 and 34 and extended portions 93 and 95, respectively, by the provision of a lap joint engagement. Such a configuration is depicted in FIG. 9, where a cross-sectional enlarged view of the juncture between a sidewall 32 of a base 12 and an extended portion 93 of a mid-cover 14 is provided. The lap joint is formed via a step portion 99 along the inside of extended wall 93 of mid-cover 14 at the lower end thereof and a corresponding and complementary step portion 31 along the outside of sidewall 32 of base 12 at the upper end thereof. The dimensions of the molded case and mid-cover allow for a secure press fit or a frictional engagement therebetween. In a preferred embodiment shown in FIG. 9, the heights x of step portions 33 and 99 are equivalent to the wall thickness x. In a most preferred embodiment, the widths of step portions 33 and 99 are approximately equivalent to half of the wall thickness x, or 0.5x.

Although the molded circuit breaker enclosure of the present invention is described herein with reference to a multi-pole circuit breaker, is understood by one skilled in the art that the enclosure design may be adapted for more or less cassettes as needed.

While the invention has been described with reference to a preferred embodiment, it will be understood by those skilled in the art that various changes may be made and equivalents may be substituted for elements thereof without departing from the scope of invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A molded circuit breaker enclosure for housing one or more circuit breaker cassettes, said circuit breaker cassettes having a height, said molded circuit breaker enclosure comprising:

a base having upstanding base walls, said base walls having top edges, said base walls have a height that is less than said height of said circuit breaker cassette disposed between said base walls;

a mid-cover affixed to said base, said mid-cover includes:

a first mid-cover wall including a first extended portion, said first extended portion enclosing a portion of said circuit breaker cassettes, said first extended portion having a first bottom edge, a second mid-cover wall including a second extended portion, said second extended portion enclosing a portion of said circuit breaker cassettes, said second extend portion having a second bottom edge, wherein said bottom edges being complementary to said top edges of said base walls, said bottom edges having a lap joint engagement with said top edges; and a top-cover affixed to said mid-cover.

2. The molded circuit breaker enclosure as in claim 1, wherein said mid-cover is affixed to said base by a securing means selected from the group consisting of one or more fasteners, an adhesive bond, an interference engagement, a frictional engagement, and a combination of at least one of the foregoing securing means.

3. The molded circuit breaker enclosure as in claim 1, wherein said mid-cover is affixed to said base by a combination of frictional engagements and fasteners.

4. The molded circuit breaker enclosure as in claim 1, wherein said lap joint engagement includes a first step portion edgewise upon said top edges of said base walls, and a second step portion edgewise on said first bottom edge and said second bottom edge.

5. The molded circuit breaker enclosure as in claim 1 wherein a ratio of a height of said mid-cover walls to said height of said base walls is greater than 0.46.

6. The molded circuit breaker enclosure as in claim 1 wherein a ratio of a height of said mid-cover walls to said height of said base walls is greater than 0.60.

7. The molded circuit breaker enclosure as in claim 1 wherein a ratio of a height of said mid-cover walls to said height of said base walls is between 0.46 and 1.5.

8. The molded circuit breaker enclosure as in claim 1 wherein a ratio of a height of said mid-cover walls to said height of said base walls is between 0.61 and 1.25.

9. The molded circuit breaker enclosure as in claim 4, wherein said first step portion has a step portion width that is equal to one-half a step portion height.

10. The molded circuit breaker enclosure as in claim 4, wherein said second step portion has a step portion width that is equal to one-half a step portion height.

11. A circuit breaker comprising:

a load strap;

a circuit breaker cassette coupled to said load strap;

an enclosure for housing said circuit breaker cassette, said enclosure includes:

a base having upstanding base walls, said base walls having top edges, said base walls have a height that is less than said height of said circuit breaker cassette disposed between said base walls;

a mid-cover affixed to said base, said mid-cover includes:

a first mid-cover wall including a first extended portion, said first extended portion enclosing a portion of said circuit breaker cassettes, said first extended portion having a first bottom edge, a second mid-cover wall including a second extended portion, said second extended portion enclosing a portion of said circuit breaker cassettes, said second extend portion having a second bottom edge, wherein said bottom edges being complementary to said top edges of said base walls, said bottom edges having a lap joint engagement with said top edges; and a top-cover affixed to said mid-cover.

12. The circuit breaker as in claim 11, wherein said mid-cover is affixed to said base by a securing means selected from the group consisting of one or more fasteners, an adhesive bond, an interference engagement, a frictional engagement, and a combination of at least one of the foregoing securing means.

13. The circuit breaker as in claim 11, where in said mid-cover is affixed to said base by a combination of frictional engagements and fasteners.

14. The circuit breaker as in claim 11, wherein said lap joint engagement includes a first step portion edgewise upon said top edges of said base walls, and a second step portion edgewise on said first bottom edge and said second bottom edge.

15. The circuit breaker as in claim 11 wherein a ratio of a height of said mid-cover walls to said height of said base walls is greater than 0.46.

16. The circuit breaker enclosure as in claim 11 wherein a ratio of a height of said mid-cover walls to said height of said base walls is greater than 0.60.

17. The circuit breaker enclosure as in claim 11 wherein a ratio of a height of said mid-cover walls to said height of said base walls is between 0.46 and 1.5.

18. The circuit breaker as in claim 11 wherein a ratio of a height of said mid-cover walls to said height of said base walls is between 0.61 and 1.25.

19. The circuit breaker as in claim 14, wherein said first step portion has a step portion width that is equal to one-half a step portion height.

20. The circuit breaker as in claim 14, wherein said second step portion has a step portion width that is equal to one-half a step portion height.

* * * * *